US007671812B1

(12) United States Patent
Yasin et al.

(10) Patent No.: US 7,671,812 B1
(45) Date of Patent: Mar. 2, 2010

(54) WIND NOISE REDUCING MOUNTING BASES FOR ANTENNA ASSEMBLIES

(75) Inventors: Hasan Yasin, Holly, MI (US); Jon Karl Larson, Fenton, MI (US); Curtis W. Beaulieu, Fenton, MI (US); Shunsuke Kinsho, Farmington, MI (US)

(73) Assignee: Laird Technologies, Inc., Chesterfield, MO (US)

( * ) Notice: Subject to any disclaimer, the term of this patent is extended or adjusted under 35 U.S.C. 154(b) by 89 days.

(21) Appl. No.: 12/192,804

(22) Filed: Aug. 15, 2008

(51) Int. Cl.
*H01Q 1/32* (2006.01)

(52) U.S. Cl. ..... 343/715; 343/888

(58) Field of Classification Search ..... 343/715, 343/888, 900, 878
See application file for complete search history.

(56) References Cited

U.S. PATENT DOCUMENTS 2,635,186 A 4/1953 Schmidt
3,105,866 A 10/1963 Little
4,625,213 A * 11/1986 Horn ..... 343/715
5,151,711 A 9/1992 Taguchi
5,214,244 A 5/1993 Cummings et al.
5,229,784 A * 7/1993 Jones ..... 343/888
5,367,971 A 11/1994 Carpenter et al.
5,600,334 A * 2/1997 Whitehouse ..... 343/715
5,710,567 A * 1/1998 Funke ..... 343/702
5,917,452 A 6/1999 Harada et al.
6,680,706 B2 1/2004 Loftus, Jr. et al.

* cited by examiner

*Primary Examiner*—HoangAnh T Le
(74) *Attorney, Agent, or Firm*—Harness, Dickey & Pierce, P.L.C.

(57) ABSTRACT

An antenna assembly is provided that includes an antenna element depending from an antenna mounting base. The mounting base includes a shaft portion that uniformly tapers from a mounting end portion to a projecting end portion. The shaft portion includes grooves, or flutes, that each extends from the mounting end portion toward the projecting end portion, and that each has a curvature about an axis of the shaft portion. The grooves provide the shaft portion with an asymmetrical cross-sectional area that causes airflow impinging on the shaft portion to generate turbulence and scatter low air pressure regions that tend to form locally around the shaft portion. As a result, small vibrations generated by the low pressure regions are suppressed, and whistling sounds, noises, etc. associated with the vibrations may be reduced.

35 Claims, 8 Drawing Sheets

WIND NOISE REDUCING MOUNTING BASES FOR ANTENNA ASSEMBLIES

FIELD

The present disclosure generally relates to wind noise reducing mounting bases for antenna assemblies, which are configured to reduce noise generated by airflow across the mounting bases of the antenna assemblies.

BACKGROUND

This section provides background information related to the present disclosure which is not necessarily prior art.

Various types of antennas are used in the automotive industry, including aerial AM/FM antennas, whip antennas, etc. Antennas for automotive use are commonly positioned on the vehicle's roof, hood, or trunk lid to help ensure that the antenna has an unobstructed view overhead or towards the zenith.

Rod-shaped antennas mounted to automobiles typically generate whistling sounds or noises when the automobiles are traveling, for example, at high speeds, etc. Such whistling sounds can be irritating and/or distracting to drivers and/or occupants of the automobiles.

SUMMARY

This section provides a general summary of the disclosure, and is not a comprehensive disclosure of its full scope or all of its features.

According to various aspects, exemplary embodiments are provided of antenna assemblies for installation to mobile platforms, for example vehicles, etc., and related methods. In one exemplary embodiment, a mounting base is provided for an antenna assembly that is suitable for installation to a mobile platform and configured for reduced noise generation during travel. The mounting base includes a mounting end portion, a projecting end portion, and a shaft portion that extends generally between the mounting end portion and projecting end portion. The shaft portion has at least two grooves therein, each of which substantially extends from about the mounting end portion towards the projecting end portion. Each groove is oriented to have a curvature about the shaft portion such that each groove extends around only a portion of a periphery of the shaft portion.

In another exemplary embodiment of the present disclosure, an antenna assembly is provided for installation to a mobile platform. The antenna assembly includes a shaft portion having a mounting end portion and a projecting end portion. The shaft portion is tapered from the mounting end portion toward the projecting end portion. The shaft portion has at least two grooves therein that each substantially extend from about the mounting end portion toward the projecting end portion, wherein each of the grooves is oriented to have a curvature about an axis of the shaft portion of about one-hundred eighty degrees or less. The grooves provide the shaft portion with an asymmetrical cross-sectional area.

In still another exemplary embodiment of the present disclosure, an antenna assembly is provided for installation to a vehicle body wall. The antenna assembly includes an elongate mounting base having at least two flutes that each substantially extend longitudinally along the mounting base. Each flute includes a curvature about an axis of the mounting base less than about three-hundred sixty degrees around the mounting base such that each flute extends partially around and does not fully encircle a periphery of the mounting base.

The antenna assembly also includes an antenna element depending from the mounting base. The antenna element includes an antenna rod portion and a spiral element that generally encircles the antenna rod portion along a length of the antenna rod portion a plurality of times over the length of the antenna rod portion. The at least two flutes of the mounting base and the spiral element of the antenna element respectively provide the mounting base and the antenna element with an asymmetrical cross-sectional area that functions to cause air flowing across peripheries of the mounting base and the antenna element to generate significant degrees of turbulence and thereby reduce levels of noise generated by the flowing air.

In a further exemplary embodiment, an antenna assembly is installable to a mobile platform for reducing levels of noise generated by air flowing across the antenna assembly. The antenna assembly includes an elongate mounting base having a periphery, and a generally spiral-shaped groove formed in the periphery of the mounting base and recessed into the mounting base. The groove provides the mounting base with a generally asymmetrical cross-sectional area that functions to cause air flowing across the periphery of the mounting base to generate turbulence and thereby reduce levels of noise generated by the flowing air.

In another aspect of the present disclosure, an exemplary method is provided for reducing wind noise generated by a mounting base of a vehicle-mount antenna assembly. The method includes installing on a vehicle an antenna mounting base having a tapered shaft portion including at least three grooves therein, each of which substantially extends from about the proximal end portion towards the distal end portion and is oriented to have a curvature about the axis of the tapered shaft portion such that the groove extends only partially around the periphery of the tapered shaft portion. The method also includes installing an antenna rod element depending from the tapered shaft portion, which includes a spiral element protruding outwardly a distance from the antenna rod element, and continuously encircling the antenna rod element. The method further includes exposing the antenna assembly to airflow across the antenna assembly, wherein the grooves in the tapered shaft portion and the protruding element on the antenna rod function to cause airflow across the outer surface of the antenna assembly to generate a significant degree of turbulence, to thereby reduce the level of noise generated by air flowing across the antenna base.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure in any way.

Corresponding reference numerals indicate corresponding parts throughout the several views of the drawings.

DETAILED DESCRIPTION

Figure 1:
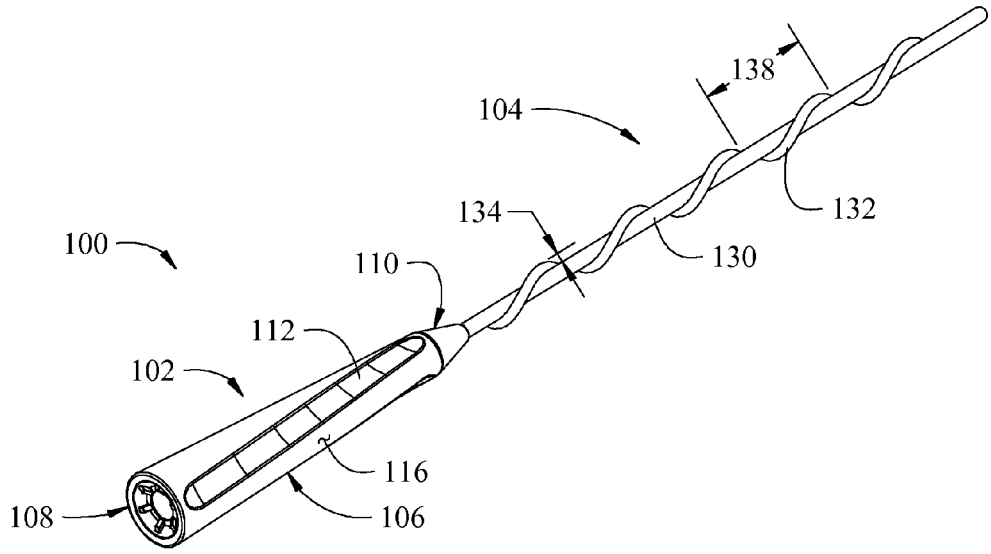
FIG. 1 is a rearward perspective view of an antenna assembly according to one exemplary embodiment of the present disclosure.
Figure 2:
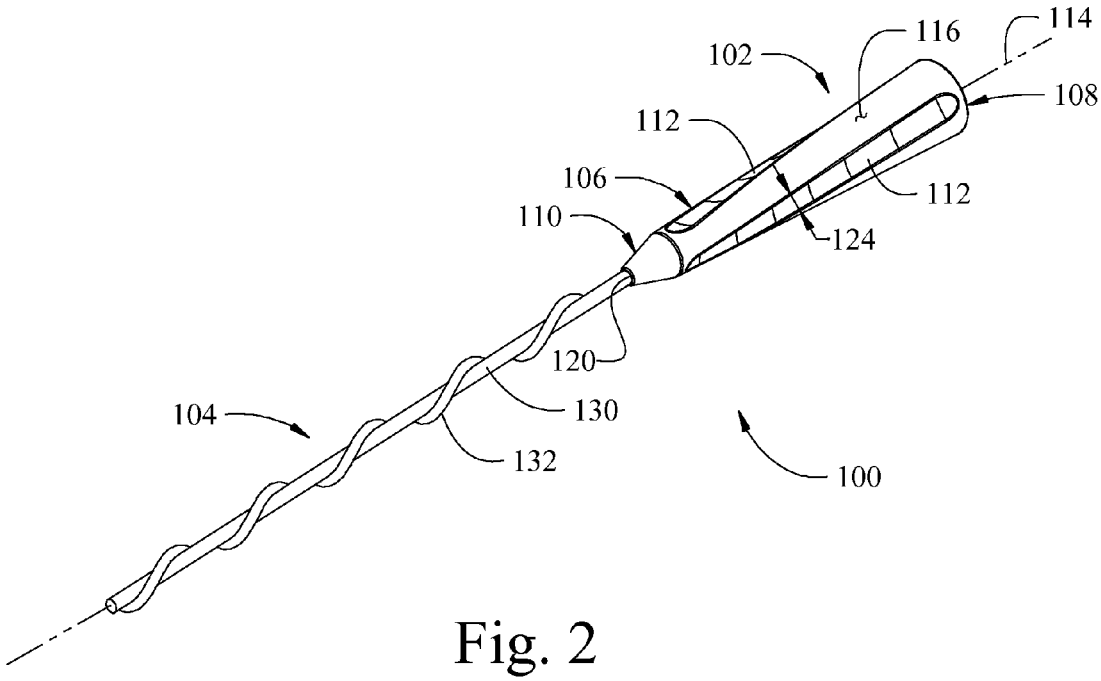
FIG. 2 is a forward perspective view of the antenna assembly of FIG. 1.
Figure 3:
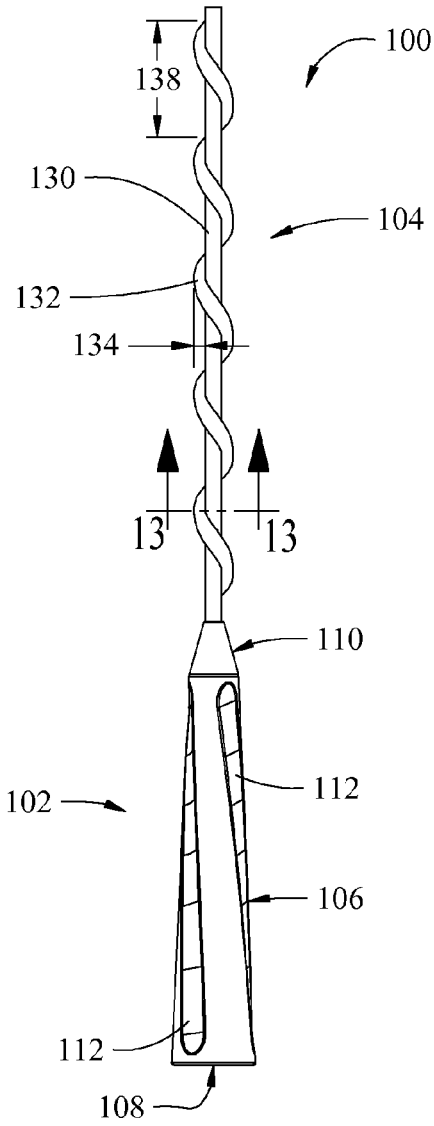
FIG. 3 is a side elevation view of the antenna assembly shown in FIG. 1.
Figure 4:
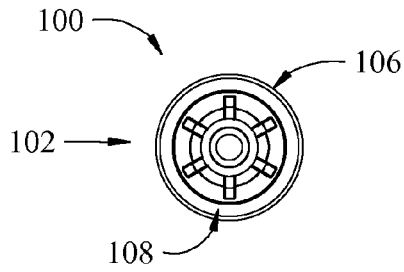
FIG. 4 is a bottom plan view of the antenna assembly shown in FIG. 1.

In the following description, numerous specific details are set forth such as examples of specific components, devices, methods, in order to provide a thorough understanding of embodiments of the present disclosure. It will be apparent to a person of ordinary skill in the art that these specific details need not be employed, and should not be construed to limit the scope of the disclosure. In the development of any actual implementation, numerous implementation-specific decisions must be made to achieve the developer's specific goals, such as compliance with system-related and business-related constraints. Such a development effort might be complex and time consuming, but is nevertheless a routine undertaking of design, fabrication and manufacture for those of ordinary skill.

The various disclosed embodiments generally provide antenna assemblies designed for installation to, for example, mobile platforms such as automobiles, boats, motorcycles, other vehicles, etc. Aspects of the present disclosure relate, for example, to antenna assemblies having mounting bases (broadly, mounting assemblies) that are configured to receive different antenna elements (e.g., whip-type antenna elements, etc.) for installation to, for example, mobile platforms. Antenna assemblies disclosed herein may thus, for example, provide improved performance with regard to dampening, reducing, inhibiting, etc. whistling sounds, noises, etc. generated, for example, when a vehicle is traveling at high speeds and air moves past, across, etc. the antenna assemblies.

In some embodiments, antenna assemblies are configured such that antenna elements are easily installed or assembled to mounting bases. In addition, the mounting bases and/or the antenna elements disclosed herein may provide for reduced, dampened, inhibited, etc. wind-generated whistling sounds, noises, etc. as air moves past, across, etc. the mounting bases and/or the antenna elements.

Additionally, aspects of the present disclosure may allow for use of similar mounting bases with different types of antenna elements. By allowing for the use of a single mounting base design, configuration, etc. with different types of antenna elements, aspects of the present disclosure may also allow for use of common parts and common tooling to produce the antenna assemblies, which may, in turn, allow for reduced costs.

With reference now to the drawings, FIGS. 1 through 13 illustrate one embodiment of an exemplary antenna assembly 100 illustrating one or more aspects of the present disclosure. The antenna assembly 100 may, for example, be installed to a mobile platform, such as a vehicle body wall, (not shown). As shown in FIGS. 1 through 3, 6 through 8, and 11, the antenna assembly 100 generally includes a mounting base 102 and an antenna element 104. The mounting base 102 includes an elongate shaft portion 106 that, as shown, is somewhat tapered from a larger diameter at a mounting end portion 108 toward a smaller diameter at a projecting end portion 110. The illustrated projecting end portion 110 includes a conical tapered tip having an opening 120 (also termed, for example, an aperture, etc.) therein (e.g., FIGS. 2, 7, and 11, etc.). Alternatively, shaft portions of antenna assemblies may have generally constant cross-sections, with generally straight profiles. Likewise, shaft portions could have circular, square, or other cross-sectional profiles within the scope of the present disclosure.

Figure 5:
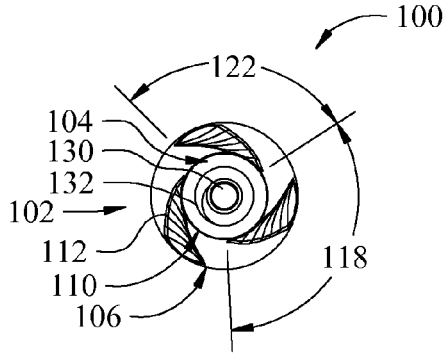
FIG. 5 is a top plan view of the antenna assembly shown in FIG. 1.
Figure 6:
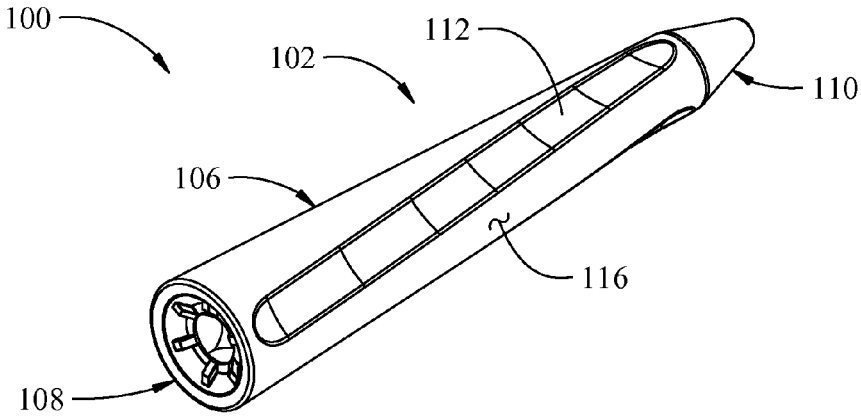
FIG. 6 is a rearward perspective view similar to FIG. 1 with an antenna element of the antenna assembly removed, and illustrating a mounting base of the antenna assembly.
Figure 7:
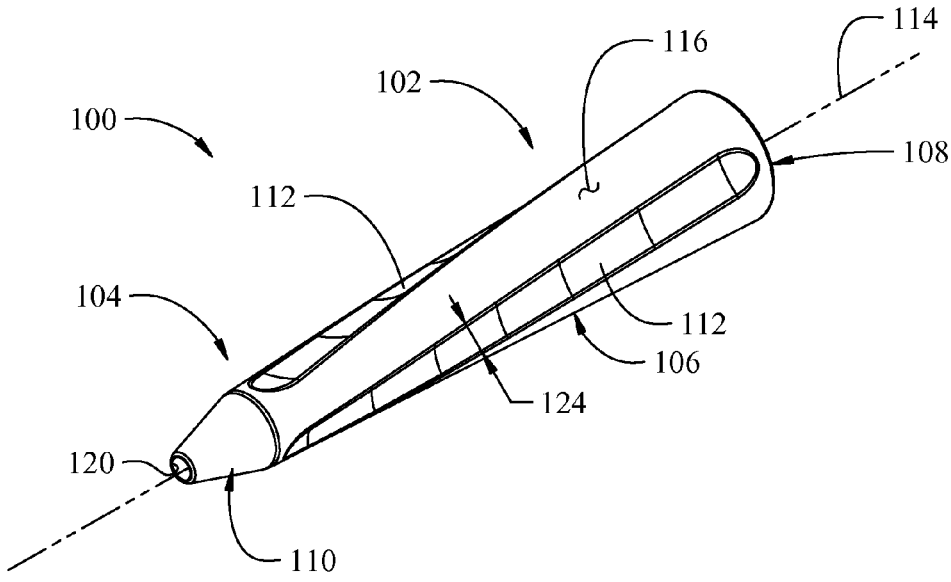
FIG. 7 is a forward perspective view of the mounting base of FIG. 6.
Figure 8:
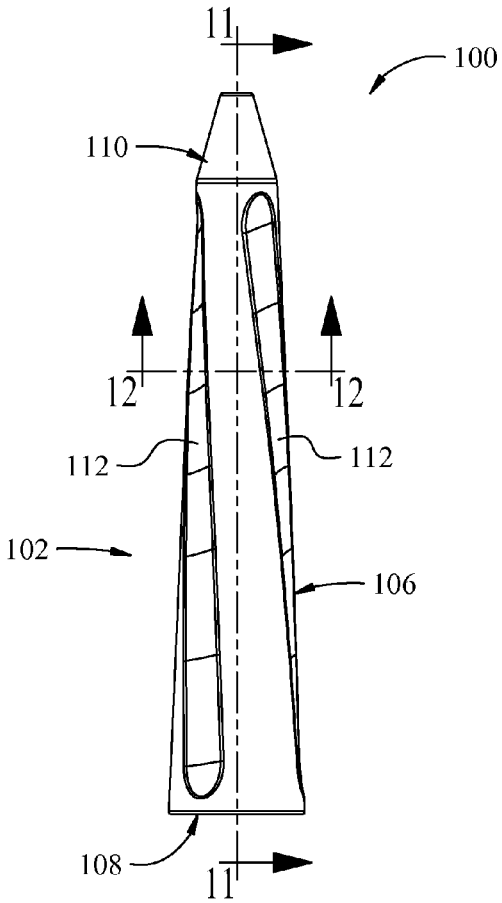
FIG. 8 is a side elevation view of the mounting base of FIG. 6.
Figure 9:
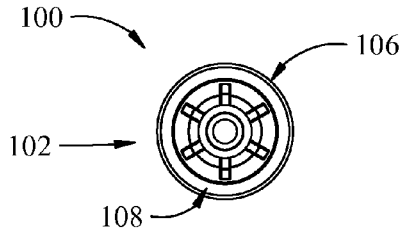
FIG. 9 is a bottom plan view of the mounting base of FIG. 6.
Figure 10:
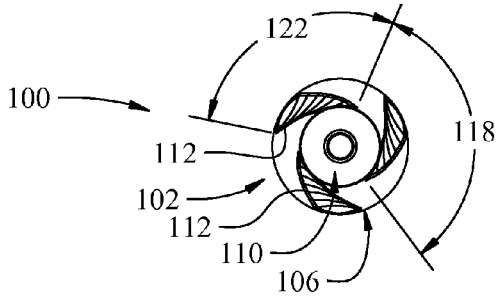
FIG. 10 is a top plan view of the mounting base of FIG. 6.
Figure 11:
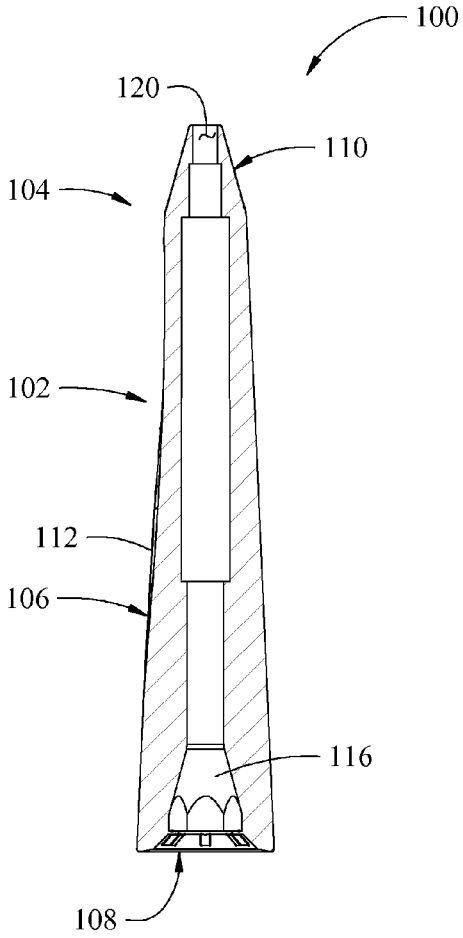
FIG. 11 is a section view of the mounting base taken in a plane including line 11-11 in FIG. 8.

The shaft portion 106 of the illustrated antenna assembly 100 has included therein three grooves 112 (also termed flutes, etc.), each of which substantially extends from the mounting end portion 108 toward the projecting end portion 110, generally longitudinally along the shaft portion 106 (e.g., FIGS. 5 and 10, etc.). While only three grooves 112 are shown in the illustrated shaft portion 106, in other exemplary embodiments, shaft portions alternatively could include more than or fewer than three grooves. For example, in another exemplary embodiment, a shaft portion includes two grooves; and in still another exemplary embodiment, a shaft portion includes five symmetrically spaced grooves therein.

Referring to FIGS. 4, 5, 9, and 10, each of the grooves 112 in the illustrated antenna assembly 100 extends only partially around a periphery 116 of the shaft portion 106, and does not fully encircle the shaft portion 106. For example, the illustrated grooves 112 may each include a generally spiral (or generally helical) shape that extends only partially around the periphery 116 of the shaft portion 106. As shown in FIGS. 5 and 10, each of the grooves 112 is oriented to have a curvature 122, or angular rotation, about an axis 114 (FIGS. 2 and 7) of the shaft portion 106 such that the grooves 112 extend around only a portion of a periphery 116, or outer surface, (e.g., FIGS. 1, 2, 6, and 7, etc.) of the shaft portion 106 (and around only a portion of a circumference of the shaft portion 106, for example, less than three-hundred sixty degrees circumferentially around the periphery 116 of the shaft portion 106, etc.). In the illustrated embodiment, for example, each of the grooves 112 has the curvature 122, or angular rotation, about the axis 114 of the shaft portion 106 of less than about one-hundred eighty degrees, and more specifically of less than about one-hundred twenty degrees.

In the illustrated embodiment, each of the grooves 112 is disposed between a corresponding pair of grooves 112. And each of the grooves 112 is circumferentially spaced apart from each other by a predetermined spacing 118 (FIGS. 5 and 10). Depending on how many grooves 112 are in the shaft portion 106, the predetermined spacing 118 is that which is provided by an angular spacing between each of the grooves 112, for example, between about seventy-two degrees (e.g., for 5 grooves, etc.) and about one-hundred eighty degrees (e.g., for 2 grooves, etc.). In the illustrated embodiment, the shaft portion 106 has three grooves 112 with a predetermined angular spacing 118 of about one-hundred twenty degrees.

Figure 12:
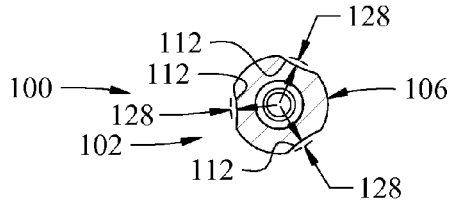
FIG. 12 is a section view of the mounting base taken in a plane including line 12-12 in FIG. 8.
Figure 13:
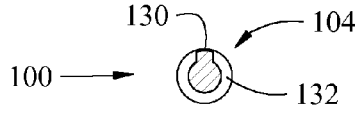
FIG. 13 is a section view of the antenna assembly's antenna element taken in a plane including line 13-13 in FIG. 3.

Also in the illustrated embodiment, each of the grooves 112 includes a width dimension 124 (FIGS. 2 and 7) that generally tapers in width from about the mounting end portion 108 toward the projecting end portion 110. The width dimension 124 of each of the grooves 112 (at a longitudinal position along a length of the shaft portion 106) may range between about 35 percent and about 65 percent of a corresponding diameter dimension of the shaft portion 106. The grooves 112 are also each generally recessed into the shaft portion 106 such that they include a depth dimension 128 (FIG. 12). The depth dimension 128 of each of the grooves 112, as measured radially inwardly from the outside diameter (or outer periphery, etc.) at a given point of the shaft portion 106, may be between about five percent and about twenty-five percent of a corresponding diameter dimension of the shaft portion 106.

The grooves 112 provide the shaft portion 106 with an asymmetrical cross-sectional area that functions to cause airflow impinging on the periphery 116 of the shaft portion 106 to generate a significant degree of turbulence, so that low atmospheric pressure regions that tend to form locally around the shaft portion 106 may be scattered. As a result, small vibrations which are otherwise generated by the low pressure regions are suppressed, and the whistling sounds, noises, etc. which may be associated with the vibrations, are substantially reduced.

In the illustrated antenna assembly 100, the antenna element 104 includes a whip-type antenna element, which depends from the opening 120 in the projecting end portion 110 of the shaft portion 106 of the mounting base 102. In particular in forming the antenna assembly 100, the mounting base 102 may be overmolded onto the antenna element 104 to couple the antenna element 104 to the mounting base 102.

With reference to FIGS. 1-3, 5, and 13, the antenna element 104 includes an antenna rod portion 130 and a spiral element 132 (e.g., raised straking, etc.) that generally encircles around the antenna rod portion 130 along a length of the antenna rod portion 130. The spiral element 132 protrudes, extends, etc. outwardly a distance 134 (e.g., a strake, etc.) (FIGS. 1 and 3) from the antenna rod portion 130. The distance 134 may be, for example, between about twenty percent and about sixty-five percent of a diameter of the antenna rod portion 130. The spiral element 132 also functions to provide the antenna element 104 with an asymmetrical cross-sectional area, in forming flutes around the antenna rod portion 130. The asymmetrical cross-sectional area functions to cause airflow across the antenna element 104 to generate a significant degree of turbulence for reducing the whistling sound generated by the airflow. In the illustrated embodiment, the spiral element 132 extends completely around a circumference of the antenna rod portion 130 one time over a length 138 (FIGS. 1 and 3) longitudinally along the rod portion 130. The length 138 may be, for example, between about 0.50 (about 12.7 millimeters) inches and about 1.50 inches (about 38.1 millimeters). The length 138 over which the spiral element 132 encircles the antenna rod portion 130 may also be referred to as a pitch of the spiral element 132. In the illustrated embodiment, the length 138 (or pitch) over which the spiral element 132 encircles the antenna rod portion 130 is about 0.880 inches (about 22.35 millimeters). In addition in the illustrated embodiment, the illustrated spiral element 132 fully encircles the antenna rod portion 130 about 5 times. In other exemplary embodiments, spiral elements may fully encircle an antenna rod portion less than or more than five times.

A fastener (not shown) may be provided for installing the antenna assembly 100 to a vehicle body wall (not shown). For example, the fastener may include a threaded bolt, screw, etc. coupled to the mounting end portion 108 of the shaft portion 106 of the mounting base 102 and configured (sized, shaped, constructed, etc.) to couple the antenna assembly 100 to the vehicle body wall. Alternatively, the fastener may include a contoured recess such as a hex-shaped recess configured to receive a hex nut for fastening the antenna assembly 100 to a vehicle body wall. As another alternative, the fastener may comprise a D-shaped recess for receiving a D-shaped fastener element. As still other alternatives, the fastener may comprise, for example, an internally threaded hex nut, an externally threaded screw, other suitable structure for coupling to a vehicle body wall, etc.

Figure 14:
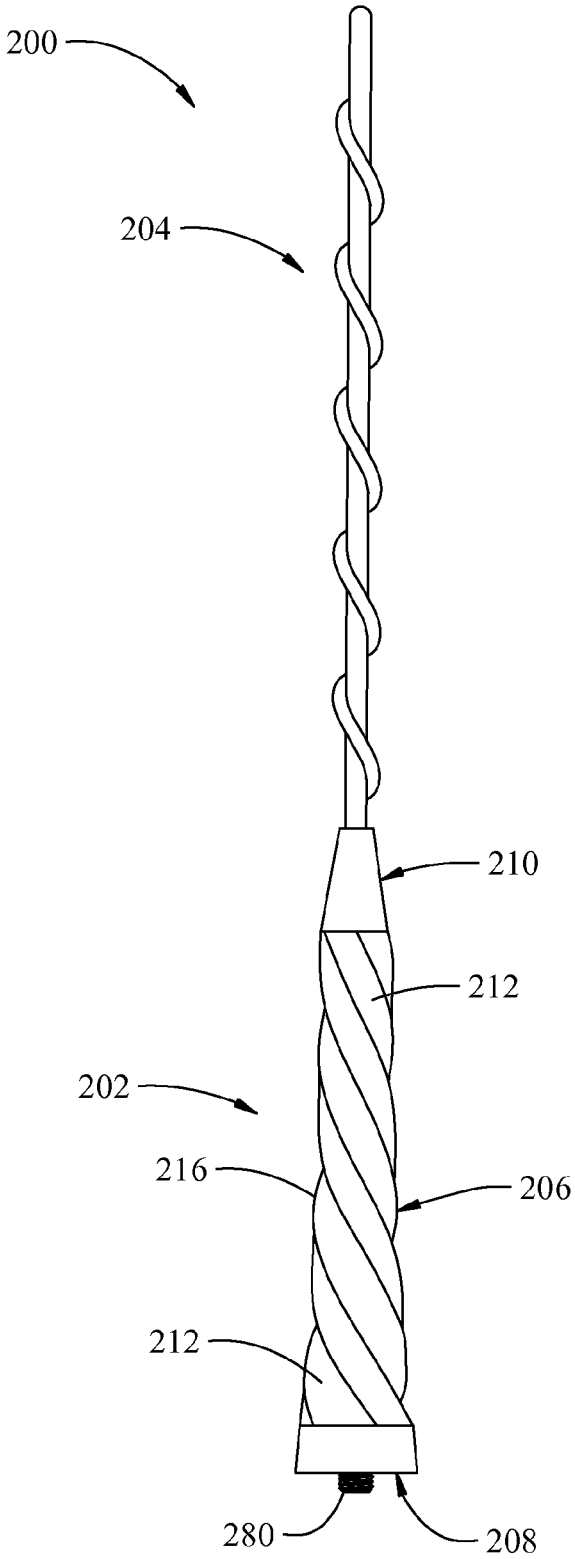
FIG. 14 is a side elevation view of an antenna assembly according to another exemplary embodiment of the present disclosure.

FIG. 14 illustrates another exemplary embodiment of an antenna assembly 200 embodying one or more aspects of the present disclosure. The antenna assembly 200 generally includes an elongate mounting base 202 and an antenna element 204 extending, depending, etc. generally away from the mounting base 202 at a projecting end portion 210 of the mounting base 202. The mounting base 202 includes an elongate shaft portion 206 that, as shown, is somewhat tapered from a larger diameter at a mounting end portion 208 toward a smaller diameter at the projecting end portion 210. A threaded fastener 280 may be provided for installing the antenna assembly 200 to a vehicle body wall (not shown).

In this embodiment, the mounting base's shaft portion 206 includes a groove 212 (also termed a flute, etc.) formed in a periphery 216 of the shaft portion 206. The groove 212 is recessed into the mounting base's shaft portion 206 such that it includes a depth dimension measured radially inwardly from the periphery 216 of the mounting base 202 to the groove 212. The groove 212 may be formed integrally in the shaft portion 206 when, for example, the shaft portion 206 is molded from a piece of material.

Also in this embodiment, the groove 212 extends, wraps, etc. circumferentially around the mounting base's shaft portion 206 along a longitudinal length of the shaft portion 206 such that the groove 212 generally encircles the shaft portion 206. The illustrated groove 212 may include a generally spiral (or generally helical) shape that extends completely around the shaft portion 206. The groove 212 thus provides the shaft portion 206 with an asymmetrical cross-sectional area that functions to cause airflow impinging on the periphery 216 of the shaft portion 206 to generate a significant degree of turbulence, so that low atmospheric pressure regions that tend to form locally around the shaft portion 206 may be scattered. As a result, small vibrations which are otherwise generated by the low pressure regions are suppressed, and the whistling sounds, noises, etc. which may be associated with the vibrations, are substantially reduced.

In another exemplary embodiment, an antenna assembly embodying one or more aspects of the present disclosure is described together with exemplary dimensions thereof. These dimensions, however, are disclosed for purposes of illustration only and not for purposes of limitation.

For example, the exemplary antenna assembly of this embodiment may include a mounting base having a shaft portion that tapers from a diameter of about 0.875 inches (about 22.23 millimeters) at a mounting end portion to a diameter of about 0.500 inches (about 12.7 millimeters) at a projecting end portion. The projecting end portion may include a conical tapered tip having an opening therein for receiving an antenna element. The shaft portion may have three grooves therein that each substantially extends from the mounting end portion to the projecting end portion. Each of the grooves may be oriented to have a curvature, or angular rotation, about an axis of the shaft portion of about one-hundred twenty degrees relative to the axis. Each of the grooves may extend around only a portion of a periphery of the shaft portion, and may not fully encircle the shaft portion. The three grooves may be circumferentially spaced apart from each other by a predetermined spacing of about one-hundred twenty degrees. Each groove may have a radial depth dimension, relative to the outside diameter of the shaft portion, of about 0.015 inches (about 0.381 millimeters). Each groove may have a width dimension that tapers from the mounting end portion to the projecting end portion, and that may range between a width of about 0.250 inches (about 6.35 millimeters) (about 50 percent of the shaft diameter) at the projecting end portion and a width of about 0.280 inches (about 7.11 millimeters) (about 35 percent of the shaft diameter) at the mounting end portion. The grooves may generally define flute regions that provide the shaft portion with an asymmetrical cross-sectional area that functions to cause airflow across an outer surface of the antenna base to generate a significant degree of turbulence, for scattering low pressure regions around the antenna that cause whistling sounds, noises, etc. to be generated.

The exemplary antenna assembly may further include an antenna element in the form of a whip-type antenna element which depends from the projecting end portion of the shaft portion of the mounting base. The antenna element may include an antenna rod portion and a spiral element that encircles the antenna rod portion at least 3.5 times, each over a length of about 3 inches (about 76 millimeters), or at a predetermined pitch of about 3 inches (about 76 millimeters). The antenna rod portion may have a diameter of between about 0.150 inches (about 3.81 millimeters) and about 0.250 inches (about 6.35 millimeters), and the spiral element may protrude a distance of about 0.040 inches (about 1.016 millimeters) from the antenna rod portion to form flute regions around the antenna rod portion that provide the antenna element with an asymmetrical cross-sectional area, which functions to cause airflow across the antenna element to generate a significant degree of turbulence for reducing whistling sounds, noises, etc. generated by airflow over the antenna element. This exemplary antenna may provide an improved performance in dampening, reducing, inhibiting, etc. sounds, noises, etc. generated by the antenna assembly, for example, when exposed to a high rate of speed.

Figure 15:
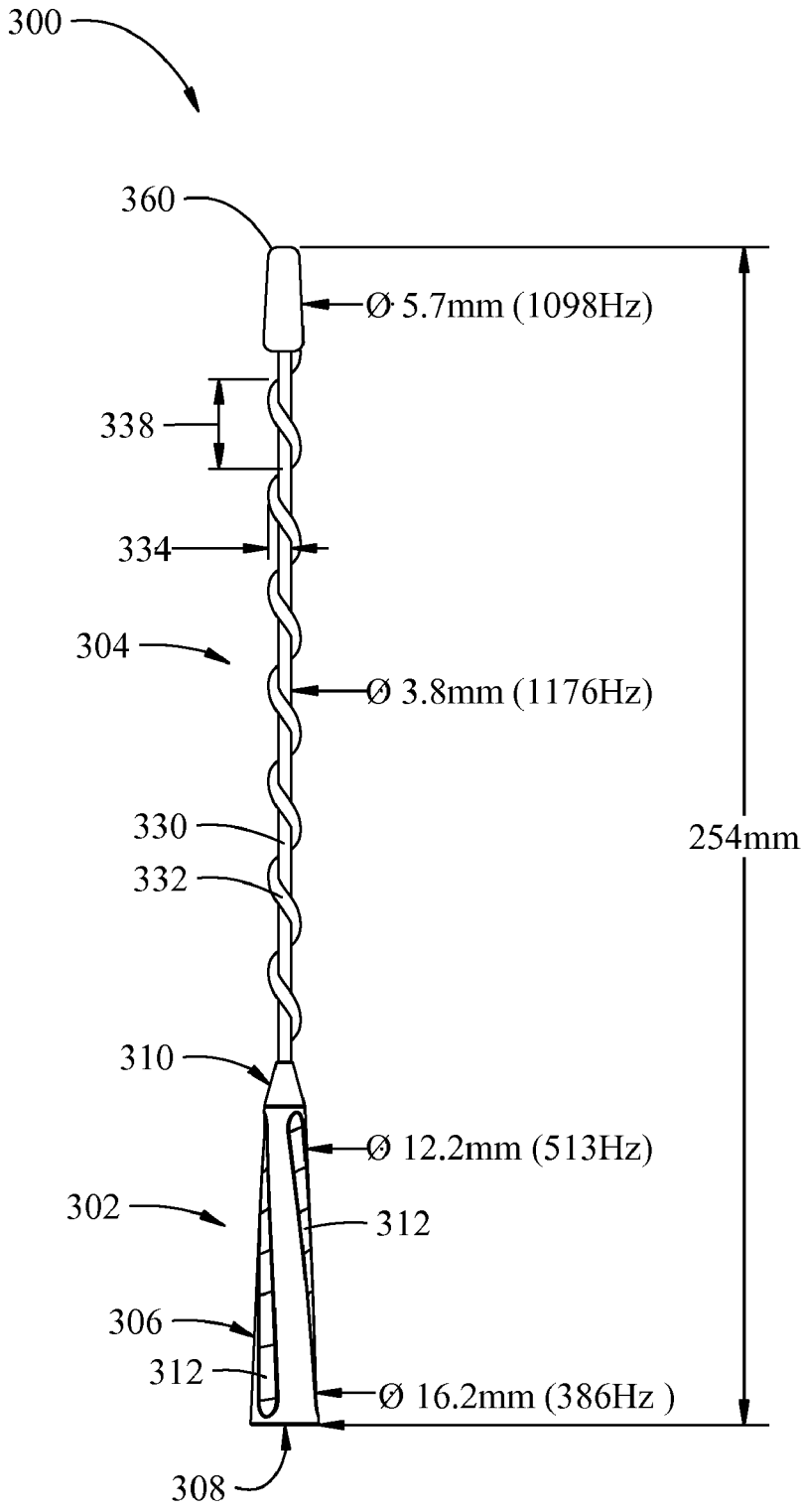
FIG. 15 is a side elevation view of an antenna assembly according to another exemplary embodiment of the present disclosure with exemplary dimension provided for purposes of illustration only.
Figure 16:
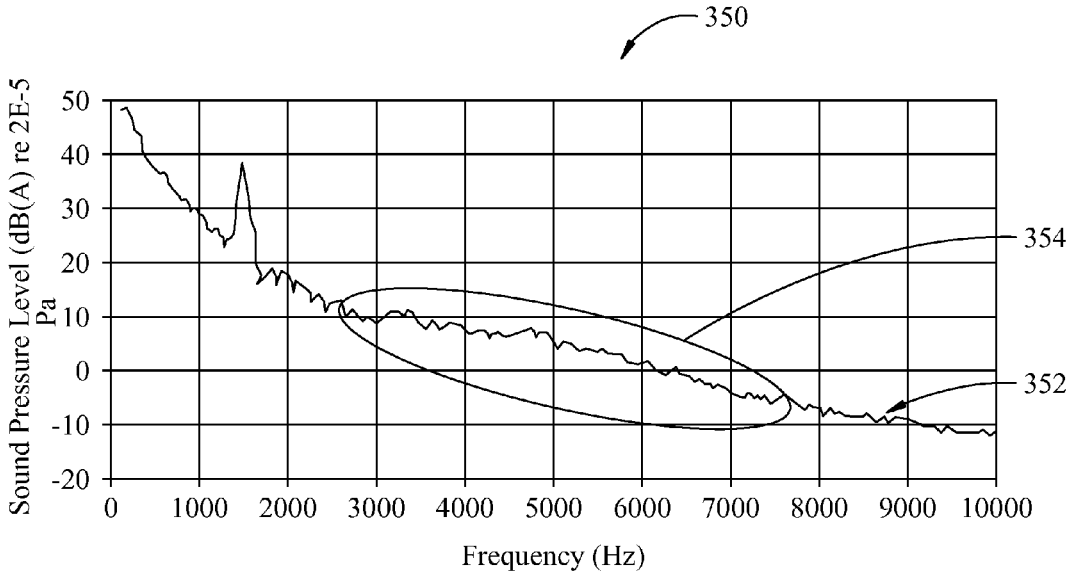
FIG. 16 is a graphical illustration of wind noise generated by the antenna assembly of FIG. 15.

FIGS. 15 and 16 illustrate still another exemplary embodiment of an antenna assembly 300 embodying one or more aspects of the present disclosure. FIG. 15 provides exemplary dimensions of the antenna assembly 300 for purposes of illustration only and not for purposes of limitation. FIG. 16 provides a graphical illustration 350 of exemplary wind noise generated by the antenna assembly 300 as air is moved across, past, etc. the antenna assembly 300.

The antenna assembly 300 generally includes a mounting base 302 and an antenna element 304 extending, depending, etc. generally away from the mounting base 302 at a projecting end portion 310 of the mounting base 302. An overall, longitudinal height of the antenna assembly 300 (e.g., of the mounting base 302 and antenna element 304, etc.) is about 10.0 inches (about 254 millimeters). The mounting base 302 includes an elongate shaft portion 306 that, as shown, is somewhat tapered from a larger diameter at a mounting end portion 308 toward a smaller diameter at the projecting end portion 310. The shaft portion 306 tapers from a diameter of about 0.640 inches (about 16.2 millimeters) at the mounting end portion 308 to a diameter of about 0.480 inches (about 12.2 millimeters) at the projecting end portion 310.

The shaft portion 306 of the illustrated antenna assembly 300 has included therein three grooves 312 (also termed flutes, etc.), each of which substantially extends from the mounting end portion 308 toward the projecting end portion 310, generally longitudinally along the shaft portion 306. Only two grooves 312 are visible in FIG. 15. Each groove 312 extends only partially around the shaft portion 306, and does not fully encircle the shaft portion 306. For example, the illustrated grooves 312 may each include a generally spiral (or generally helical) shape that extends only partially around the shaft portion 306. Each groove 312 also generally tapers in width from about the mounting end portion 308 toward the projecting end portion 310, and is generally recessed into the shaft portion 306.

The grooves 312 provide the shaft portion 306 with an asymmetrical cross-sectional area that functions to cause airflow impinging on the shaft portion 306 to generate a significant degree of turbulence, so that low atmospheric pressure regions that tend to form locally around the shaft portion 306 may be scattered. As a result, small vibrations which are otherwise generated by the low pressure regions are suppressed, and the whistling sounds, noises, etc. which may be associated with the vibrations, are substantially reduced.

The antenna assembly 300 also includes an antenna element 304 with a rod portion 330 having a diameter of about 0.15 inches (about 3.8 millimeters) and a spiral element 332 that encircles the rod portion about 3.5 times over a length 338, or pitch, of about 3 inches (about 76 millimeters). The spiral element protrudes, extends, etc. outwardly a distance 334 from the rod portion about 0.04 inches (about 1.0 millimeters).

With reference now to FIG. 16, wind noise generated by air flowing across the exemplary antenna assembly 300 is graphically illustrated at 350. In particular, line 352 represents sound pressure levels (decibels re 20 micro-Pascals) generated by airflow across the antenna assembly 300 at different frequencies, ranging from about 0 Hz to about 10,000 Hz. Different longitudinal height locations along the antenna assembly 300 may be correlated to different frequencies (FIG. 15), and sound pressure levels generated by airflow at each longitudinal height location can be measured at each corresponding frequency. For example, wind noise generated toward the mounting end portion 308 of the mounting base 302 may be measured at a frequency of about 368 Hz; wind noise generated toward the projecting end portion 310 of the mounting base 302 may be measured at a frequency of about 513 Hz; wind noise generated toward a tip 360 of the antenna element 304 (which includes a diameter of about 0.22 inches (about 5.7 millimeters)) may be measured at a frequency of about 1098 Hz; and wind noise generated toward a longitudinal center of the antenna element 304 may be measured at a frequency of about 1176 Hz.

As shown in FIG. 16, sound pressure levels of between about 30 dB re 20 micro-Pa and about 40 dB re 20 micro-Pa are generated by the illustrated mounting base 302 (e.g., between frequencies of about 386 Hz and about 513 Hz) as airflow moves across the mounting base 302. And minimal, if any, tone (e.g., spikes in sound pressure levels, etc.) is generated by the mounting base 302 (e.g., between frequencies of about 386 Hz and about 513 Hz). In addition, minimal broadband wind noise (generally indicated at circled region 354), or whistle tone, is present for the antenna assembly 300 between frequencies of about 3000 Hz and about 7000 Hz.

It should be understood that embodiments and aspects of the present disclosure may be used in a wide range of antenna applications, such as antennas configured for receiving cellular phone signals, Global Positioning System (GPS), cellular signals, etc.), antennas configured for receiving RF energy or radio transmissions (e.g., AM/FM radio signals, etc.), or combinations thereof, among other applications in which wireless signals are received by antennas. Accordingly, the scope of the present disclosure should not be limited to only one specific form/type of antenna assembly.

Numerical dimensions and values are provided herein for illustrative purposes only. The particular dimensions and values provided are not intended to limit the scope of the present disclosure.

Terms such as "upper," "lower," "inner," "outer," "inwardly," "outwardly," and the like when used herein refer to positions of the respective elements as they are shown in the accompanying drawings, and the disclosure is not necessarily limited to such positions. Terms such as "first," "second," and other numerical terms when used herein do not imply a sequence or order unless clearly indicated by the context.

When introducing elements or features and the exemplary embodiments, the articles "a," "an," "the" and "said" are intended to mean that there are one or more of such elements or features. The terms "comprising," "including," and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

The foregoing description of the embodiments of the present invention has been provided for purposes of illustration and description. It is not intended to be exhaustive or to limit the invention to the precise forms disclosed. Individual elements or features of a particular embodiment are generally not limited to that particular embodiment, but, where applicable, are interchangeable and can be used in a selected embodiment, even if not specifically shown or described.

What is claimed is:

1. A mounting base for an antenna assembly suitable for installation to a mobile platform and configured for reduced noise generation during travel, the mounting base comprising:

a mounting end portion;

a projecting end portion; and a shaft portion that extends generally between the mounting end portion and projecting end portion, the shaft portion having at least two grooves therein, each of which substantially extends from about the mounting end portion towards the projecting end portion;

wherein each groove is oriented to have a curvature about the shaft portion such that each groove extends around only a portion of a periphery of the shaft portion.

2. The mounting base of claim 1, wherein each groove includes a flute.

3. The mounting base of claim 1, wherein each groove extends around less than half a circumference of the shaft portion.

4. The mounting base of claim 1, wherein the shaft portion has a generally circular cross-sectional profile, and the grooves in the shaft portion provide the shaft portion with an asymmetrical cross-sectional area that functions to cause airflow across the periphery of the shaft portion to generate a significant degree of turbulence when air flows across the shaft portion.

5. The mounting base of claim 1, wherein each of the grooves has a curvature of less than about one-hundred twenty degrees about an axis of the shaft portion.

6. The mounting base of claim 1, wherein a depth dimension of each of the grooves is between about 0.010 inches and about 0.035 inches, as measured inwardly from an outer diameter of the shaft portion.

7. The mounting base of claim 1, wherein the shaft portion includes three or more grooves, and wherein each groove is disposed between a corresponding pair of grooves and is separated by a predetermined spacing from the other grooves of the corresponding pair of grooves.

8. The mounting base of claim 7, wherein each groove is disposed between a corresponding pair of grooves with an angular spacing between each of the grooves of between about seventy-two degrees and about one-hundred twenty degrees.

9. The mounting base of claim 1, wherein each groove generally tapers in width from about the mounting end portion toward the projecting end portion.

10. The mounting base of claim 1, wherein each groove has a width dimension between about 35 percent of an outer diameter of the shaft portion and about 53 percent of an outer diameter of the shaft portion.

11. The mounting base of claim 1, wherein each groove includes a generally spiral shape.

12. An antenna assembly comprising the mounting base of claim 1, and further comprising an antenna element depending outwardly from the projecting end portion of the shaft portion.

13. An antenna assembly for installation to a mobile platform, the antenna assembly comprising:

a shaft portion having a mounting end portion and a projecting end portion, the shaft portion being tapered from the mounting end portion toward the projecting end portion, the shaft portion having at least two grooves therein that each substantially extend from about the mounting end portion toward the projecting end portion, wherein each of the grooves is oriented to have a curvature about an axis of the shaft portion of about one-hundred eighty degrees or less, whereby the grooves provide the shaft portion with an asymmetrical cross-sectional area.

14. The antenna assembly of claim 13, wherein the shaft portion includes three grooves each oriented to have a curvature about the axis of the shaft portion of about one-hundred twenty degrees or less.

15. The antenna assembly of claim 13, further comprising an antenna element depending generally outwardly from the projecting end portion of the shaft portion.

16. The antenna assembly of claim 15, wherein the antenna element includes an antenna rod portion and a spiral element generally encircling the antenna rod portion along a length of the antenna rod portion, the spiral element encircling the antenna rod portion one complete time over a length along the antenna rod portion between about 0.500 inches and about 1 inch.

17. The antenna assembly of claim 13, wherein a depth dimension of each of the grooves is between at least about 0.010 inches and about 0.035 inches, as measured inwardly from an outer diameter of the shaft portion.

18. The antenna assembly of claim 13, wherein each of the grooves is spaced apart from each other circumferentially around the shaft portion by a predetermined spacing.

19. The antenna assembly of claim 18, wherein the predetermined spacing is an angular spacing of between about seventy-two degrees and about one-hundred eighty degrees.

20. The antenna assembly of claim 13, wherein each of the grooves generally tapers in width from about the mounting end portion toward the projecting end portion.

21. The antenna assembly of claim 13, wherein each of the grooves has a width dimension between about 35 percent of an outer diameter of the shaft portion and about 53 percent of an outer diameter of the shaft portion.

22. An antenna assembly for installation to a vehicle body wall, the antenna assembly comprising:

an elongate mounting base having at least two flutes that each substantially extend longitudinally along the mounting base, wherein each flute includes a curvature about an axis of the mounting base less than about three-hundred sixty degrees around the mounting base such that each flute extends partially around and does not fully encircle a periphery of the mounting base;

an antenna element depending from the mounting base, the antenna element including an antenna rod portion and a spiral element that generally encircles the antenna rod portion along a length of the antenna rod portion a plurality of times over the length of the antenna rod portion;

whereby the at least two flutes of the mounting base and the spiral element of the antenna element respectively provide the mounting base and the antenna element with an asymmetrical cross-sectional area that functions to cause air flowing across peripheries of the mounting base and the antenna element to generate significant degrees of turbulence and thereby reduce levels of noise generated by the flowing air.

23. The assembly of claim 22, further comprising a fastener for coupling the antenna assembly to a vehicle.

24. The assembly of claim 22, wherein the mounting base has three flutes.

25. The assembly of claim 22, wherein the flutes are each recessed into the mounting base such that they include a depth dimension measured radially inwardly from an outer periphery of the mounting base to the flute.

26. The assembly of claim 25, wherein the depth dimension of each flute is between about 0.010 inches (about 0.254 millimeters) and about 0.035 inches (about 0.889 millimeters).

27. An antenna assembly for installation to a mobile platform for reducing levels of noise generated by air flowing across the antenna assembly, the antenna assembly comprising:

an elongate mounting base having a periphery;

a generally spiral-shaped groove formed in the periphery of the mounting base and being recessed into the mounting base;

whereby the groove provides the mounting base with a generally asymmetrical cross-sectional area that functions to cause air flowing across the periphery of the mounting base to generate turbulence and thereby reduce levels of noise generated by the flowing air.

28. The antenna assembly of claim 27, wherein the generally spiral-shaped groove extends at least partly around the periphery of the mounting base.

29. The antenna assembly of claim 28, wherein the generally spiral-shaped groove encircles the periphery of the mounting base.

30. The antenna assembly of claim 27, comprising two or more generally spiral-shaped grooves.

31. The antenna assembly of claim 30, wherein each of the two or more grooves is oriented to have a curvature about the mounting base such that each groove extends around only a portion of the periphery of the mounting base.

32. The antenna assembly of claim 30, comprising three generally spiral-shaped grooves.

33. The mounting base of claim 32, wherein each of the grooves has a curvature of about one-hundred twenty degrees or less about a longitudinal axis of the mounting base.

34. The assembly of claim 27, wherein the groove is recessed into the mounting base such that the groove includes a depth dimension measured radially inwardly from an outer periphery of the mounting base to the flute.

35. The assembly of claim 27, further comprising an antenna element depending from the mounting base, the antenna element including an antenna rod portion and a spiral element that generally encircles the antenna rod portion along a length of the antenna rod portion multiple times over the length of the antenna rod portion, whereby the spiral element of the antenna element provides the antenna element with a generally asymmetrical cross-sectional area that functions to cause air flowing across a periphery of the antenna element to generate turbulence and thereby reduce levels of noise generated by the flowing air.

* * * * *